United States Patent [19]

Shirley

[11] 4,205,472

[45] Jun. 3, 1980

[54] YIELDABLE DELAYED ACTION ROADWAY AND SIGNING APPARATUS

[76] Inventor: James W. Shirley, Oak Creek Rte. Box 13, Flagstaff, Ariz. 86001

[21] Appl. No.: 968,553

[22] Filed: Dec. 11, 1978

Related U.S. Application Data

[63] Continuation-in-part of Ser. No. 782,109, Mar. 28, 1977.

[51] Int. Cl.[2] ..... G09F 7/22

[52] U.S. Cl. ..... 40/608; 40/612; 188/306; 248/289 A; 248/636

[58] Field of Search ..... 40/607, 606, 608, 612, 40/613, 617; 188/306; 248/289 A, 417, 145, 636

[56] References Cited

U.S. PATENT DOCUMENTS

| | | | |
|---|---|---|---|
| 456,707 | 7/1891 | Page | 188/306 X |
| 963,329 | 7/1910 | Shank | 248/145 |
| 1,408,636 | 3/1922 | Power | 248/289 A |
| 1,479,882 | 1/1924 | Walton | 248/417 |
| 1,522,830 | 1/1925 | Nichols et al. | 248/145 |
| 1,823,263 | 9/1931 | Fabry | 188/306 X |
| 1,837,716 | 12/1931 | Johnsen | 188/306 X |
| 1,956,303 | 4/1934 | Watson | 40/606 |
| 2,050,573 | 8/1936 | Kammerich | 248/145 |
| 2,149,050 | 2/1939 | Hajicek | 248/145 |
| 2,186,241 | 1/1940 | Glasgow | 248/289 A |
| 2,522,983 | 9/1950 | Bergstrom | 248/145 |
| 2,931,611 | 4/1960 | Watson | 248/145 |
| 3,085,546 | 4/1963 | Pelletier | 40/607 X |
| 3,161,397 | 12/1964 | Nolander | 248/417 |
| 3,367,613 | 2/1968 | Christensen | 248/145 |
| 3,637,178 | 1/1972 | Golden | 248/145 |
| 3,658,284 | 4/1972 | Haasl | 248/145 |

FOREIGN PATENT DOCUMENTS

| | | | |
|---|---|---|---|
| 2410627 | 9/1975 | Fed. Rep. of Germany | 40/606 |

*Primary Examiner*—John F. Pitrelli
*Attorney, Agent, or Firm*—Charles E. Cates

[57] ABSTRACT

A yieldable roadway signing and delineating apparatus is disclosed. A standard is positioned at a safe distance from the roadway to avoid snowplows, mowers and other errant vehicles. A horizontal moveable arm extends toward the roadway and carries a sign at its free end, thus placing the sign or delineator at the required position near the roadway for viewing by passing vehicle operators. Means for moveably retaining the arm in a desired position, permitting its deflection by pressure, and returning the arm to the desired position upon release of pressure are provided. Thus, the sign can yield to pressure from snowplow and mower attachments with a minimum or no damage to the sign. A delayed action mechanism is provided wherein a sealed fluid filled canister is eccentrically positioned around a shaft to which a gate is pivotally attached. The eccentricity creates a restriction past which the gate can be pushed by the force of the vehicle hinging on the horizontal arm, but which delays the return of the arm to its original position.

11 Claims, 8 Drawing Figures

YIELDABLE DELAYED ACTION ROADWAY AND SIGNING APPARATUS

This application is a continuation-in-part of copending U.S. Patent Application Ser. No. 782,109, filed Mar. 28, 1977.

BACKGROUND OF THE INVENTION

On vehicle roadways, particularly in areas where roadways are covered with snow for a part of the year, a continuing problem is the damage and destruction of highway signs and delineators situated at the side of the road for the guidance and warning of passing motorists. Of necessity such signs and delineators must be in close proximity to the roadway so that they can be readily observed by passing motorists. Because of their proximity to the edge of the road they are subject to damage by weed mowers and snowplows and occasionally by automobiles. In the winter months when the roadways and adjacent areas are covered with snow it is quite easy for snowplow operators to accidentally damage or ruin signs at the side of the road. They must remove enough snow to uncover the roadway and in doing so in deep snow they are likely to remove snow from too wide a path and run into the roadside marker. Mowers also do accidental damage frequently.

A number of attempts have been made by workers in the prior art to find solutions to this problem and solutions have been advanced. They invariably take the form of a flexible post which by some means can be pushed over and after being passed over by the snowplow spring back up to its original position. However, none of these ideas has been widely adopted because the devices are almost as susceptible to injury as the original posts. Although they theoretically have resilient properties and can spring back to their original position after having been knocked over, in practice the snowplow can completely uproot such posts or sever them or otherwise irreparable damage them.

Moreover, there is a need for delaying the return of the sign to its original position to prevent its scraping and thereby damaging the sides of the vehicles involved.

The problem has been around for a good many years and because of the expense of procuring, installing and replacing roadway markers, the problem is very much in need of solving and a solution has long been desired.

Having worked for many years in the Highway Section of a State Department of Transportation I have heard various maintenance supervisors complain about the heavy expense of replacing roadway signs and markers destroyed by snowplows during the preceding winter without, however, proposing a solution. I have, along with many others, observed the need for a solution to this problem, but it was not until after my retirement that a solution occurred to me.

BRIEF SUMMARY OF THE INVENTION

I have devised a means for solving this problem which will hold to a minimum the wear and tear on the roadway sign. It occurred to me that by setting the standard or post upon which the sign is mounted a safe distance away from the roadway, rotatably mounting an arm on the post and putting the sign on the free end of the arm nearest the roadway, the requirement for keeping the sign close to the roadway where it can be observed by passing motorists could be met. The arm extends from the standard toward the roadway in a generally horizontal plane, and means are provided for returning the arm to its original or first position after it has been moved aside by a vehicle. I also have provided means for suspending the sign from the arm by hinges so that the sign also can yield when struck. To further refine the concept I have adopted the idea of putting a bend in the horizontal arm so that the portion nearest the post is directed at an angle away from the roadway in the direction of travel and a second portion extends toward the roadway horizontally. This prevents or lessens the chances of impalement on the end of the arm. At the end of this latter portion the sign is attached by hinge means for additional flexible response to impact.

With particular reference to the means for positioning the arm and assuring its return to a desired first position, I have developed the following mechanism. A sleeve is vertically attached to the standard. An extension of the horizontally disposed arm extends downwardly into and through said sleeve, emerging at the other end. The horizontal portion of the arm rests and is releaseably detained in the notch provided in the top of the sleeve at the first position desired for the arm when it is in the normal sign position. A coil spring is concentrically disposed about the lower end of the extension of the arm, one end of the spring being attached to the lower end of the sleeve and the other end of the spring being attached to the vertical downward extension of the arm.

Thus, when a vehicle moves the arm aside by rotating it, the spring is compressed. When the snowplow moves on, the stored energy of the spring urges the arm back to its original position which it finds accurately by means of the notch provided in the upper end of the sleeve. The notch is deep enough to retain the arm in the desired position in the absence of pressure from a vehicle or its parts.

The delay mechanism is an especially preferred embodiment. It provides means for delaying the return of the arm to its first position wherein a sealed, fluid filled canister is eccentrically disposed about a vertical downward extension of the horizontal arm which may be integral with said arm or mechanically connected thereto by any suitable linkage. A baffle wall blocks the space between a wall of the canister and the vertical extension and the top and bottom of the canister and prevents the flow of fluid past the baffle. Gate means are attached to an eccentrically positioned shaft in the canister which may be the downward extension of the arm, or mechanically attached to it. The gate swings responsive to the arm and a restriction between the gate and the wall of the canister is created by reason of the eccentric position of the pivot point of the gate at some point in the arc of travel described at the end of the gate. The result is that the gate may move in a first direction to the restriction, but is delayed in its return to its original position by the restriction. A check valve may be optionally provided to enable the gate to move more freely in the first direction.

DETAILED DESCRIPTION OF THE PREFERRED EMBODIMENTS

Referring now to the drawings in which a presently preferred embodiment is illustrated:

Figure 1:
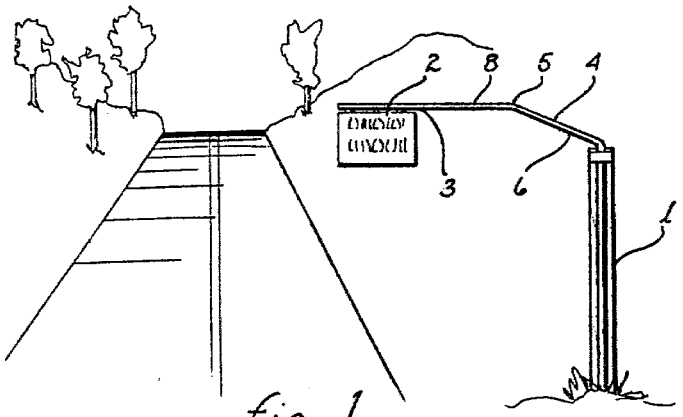
FIG. 1 illustrates a perspective view of the invention as it appears in its environment.

As illustrated in the drawing by FIG. 1 the standard 1 is physically located at a safe distance from the roadway. The sign 2 is displayed at the usual roadside position, but at the free end 3 of the horizontally disposed arm 4. The arm is fashioned with a bend 5 intermediate the end points of the horizontal portion. The first horizontal portion 6 is disposed at an angle to the line of travel of the roadway pointing in the direction of travel and the second horizontal portion 8 is perpendicular to the line of travel.

Figure 2:
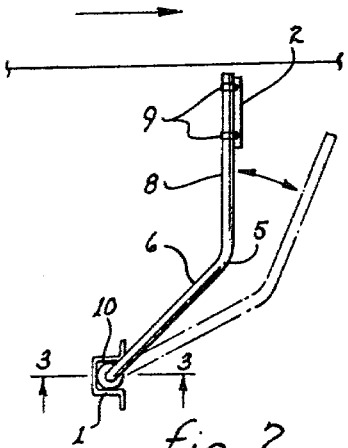
FIG. 2 is a plan view of the invention with the direction of deflection indicated by an arrow and a phantom outline of the arm.

As seen in FIG. 2 the sign 2 is attached to the second horizontal portion 8 by means of hinges 9 which permit the sign to swing freely on the arm. Thus, if struck by the passing vehicle there is extra give to the apparatus because the sign itself can swing away.

Figure 3:
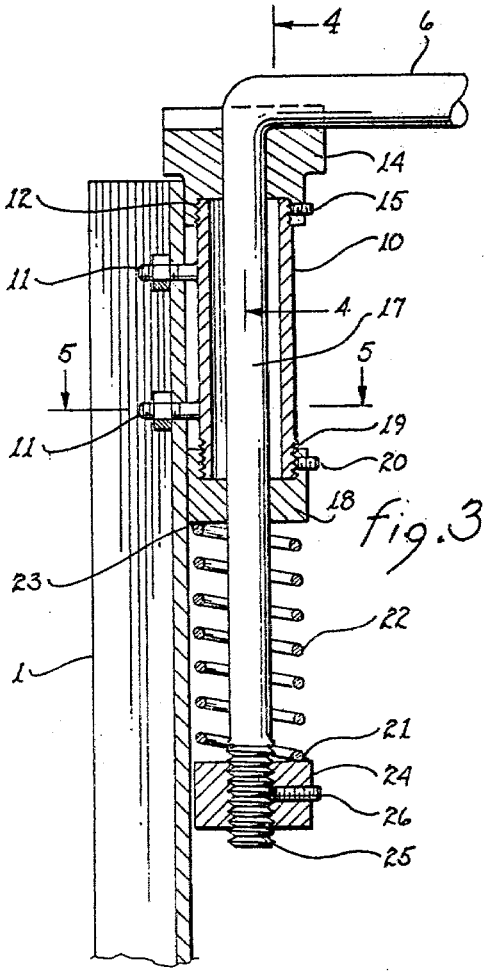
FIG. 3 is a view partly in section of the device of FIG. 2 along the lines 3—3.
Figure 4:
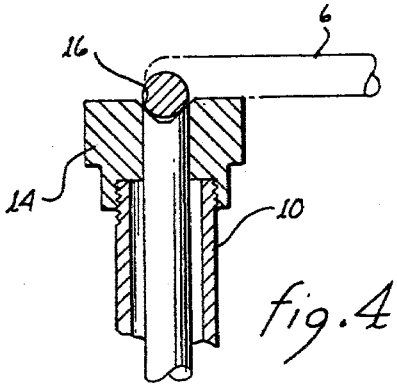
FIG. 4 is a fragmentary view of FIG. 3 along the lines 4—4.
Figure 5:
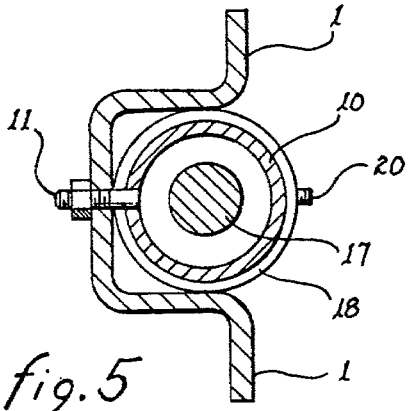
FIG. 5 is a sectional view of the device of FIG. 3 along the lines 5—5.

Referring now to FIG. 3 wherein the means for retaining the arm in a desired first position and returning it to the first position after the arm is rotated is illustrated, a sleeve 10 is attached to the standard 1 by means of bolts 11. Attached to the upper end 12 of the sleeve and comprising an extension and therefore a part of the sleeve is a first collar 14. At one end the collar is threaded and mates with threads provided on the upper end of the sleeve. The collar, which is screwed on and retained in place by means of set screw 15, can be adjusted to move the notch retaining means to more accurately position the sign. Occasion for adjustment may arise because of an inaccurate set of the standard and/or changes in tension on the coil spring. The collar 14 is provided with a notch 16 which is suitably sized and shaped to releaseably retain the first horizontal portion 6 of the arm 4. This may be better viewed in FIG. 4. A vertical extension 17 of the arm 4 passes through the first collar 14, the sleeve and the second collar 18 (the collars may be considered as an extension of the sleeve). The second collar 18 is likewise provided with threads which mate with threads provided on the lower end 19 of the sleeve 10. To provide means for securing the second collar a second set screw 20 is provided. A coil spring 22 is concentrically disposed about the vertical extension 17. The upper end 23 of the spring is welded to second collar 18. The lower end of the spring is welded to a third collar 24 which threadably engages the lower end 25 of extension 17. This collar is provided with a third set screw 26 which secures the third collar to the lower end of the extension 17. The set screw arrangement provides additional means for adjusting the tension on the spring, which may cooperate with the adjustment of first collar 14.

THE HYDRAULIC DELAY MECHANISM

Figure 6:
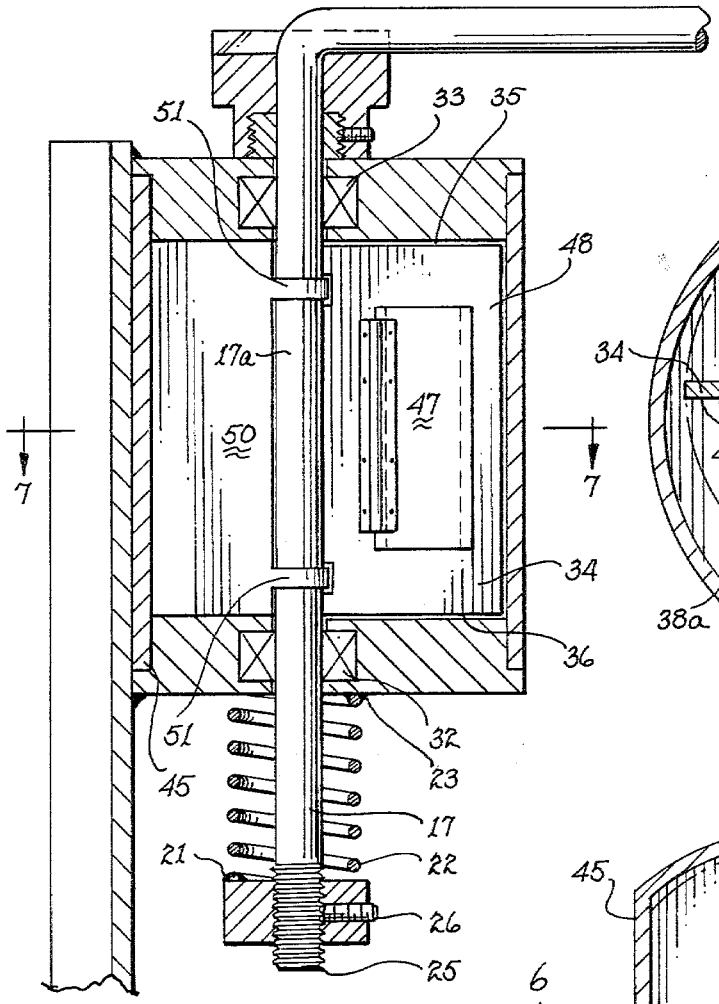
FIG. 6 is a sectional elevation view of the time delay mechanism taken along the lies 6—6 of FIG. 7.
Figure 8:
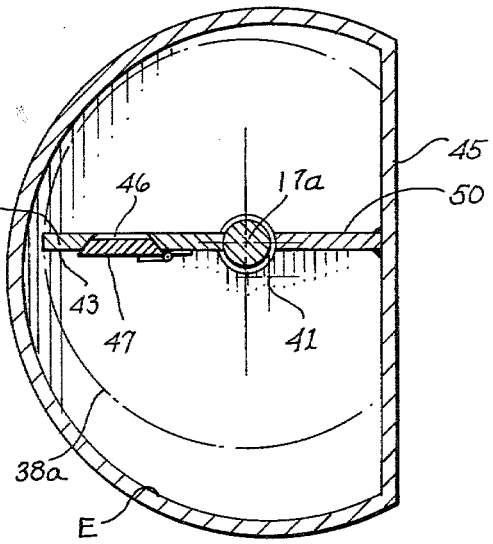
FIG. 8 is a sectional view of a time delay mechanism similar to that of FIG. 7, but designed for a reverse direction and illustrating an alternative eccentric placement of the axis of rotation.
Figure 7:
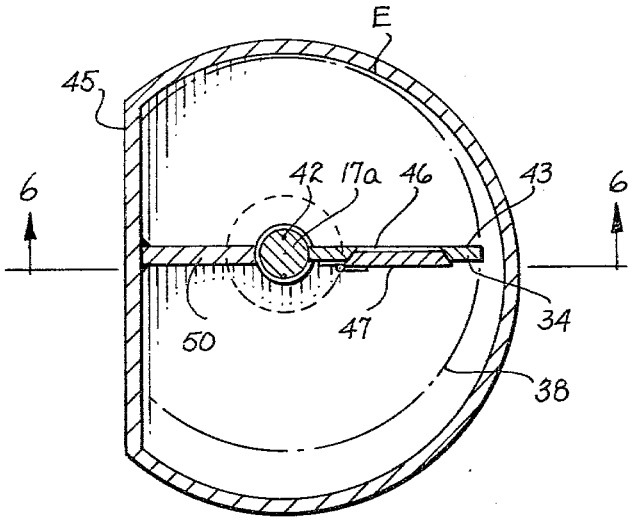
FIG. 7 is a sectional view of the view of FIG. 6 taken along the lines 7—7.

Referring to the particularly preferred embodiments shown in FIGS. 6, 7 and 8, the cavity 30 of a sealed canister 31 having a truncated cylindrical shape as shown in cross-section in FIGS. 7 and 8 is filled with suitable hydraulic fluid. The canister 31 is penetrated by a shaft 17*a* (heretofore referred to as a downward vertical extension of the horizontal arm 4) located eccentrically with respect to the axial center of the cylinder. Hydraulic sealing of the shaft at the point of entry is accomplished with seals 32, 33 to conserve fluid in the canister 31.

Attached to the shaft is gate 34 whose length is such as to provide a close fit to the top 35 and bottom 36 of the canister and whose length provides a close fit to the inside wall 39 of the canister at the point E of near oscillation of the two arcs 38 and 38*a* as seen in FIGS. 7 and 8. The arc 38 is described by the end of the gate as it is rotated through the hydraulic fluid by impetus from the rotating shaft of the apparatus to which the mechanism is attached. The point of near oscillation can be determined in any particular application by the eccentric centering of the shaft. It is shown in FIGS. 7 and 8 in two embodiments in which this point E is developed in the lower left quadrant at 41 in FIG. 8 instead of upper center at 42 as shown in FIG. 7.

It will be noted that hydraulic free flow from the leading face 43 of gate 34 to the rear is provided at end of gate 34 by the clearance developed by the eccentricity of the arc described by the end of the gate, except at point E of rotation. Initial free flow is necessary to lessen chance of distortion of apparatus components from bodies impinging on horizontal arm of apparatus. Beyond point E, clearance again develops, allowing gate to swing to wall 45 of the truncation of the canister 31 if sufficient impetus is imparted from the shaft.

The rotation of the gate is provided by the upper part 17*a* of shaft 17 of the yieldable signing apparatus as its horizontally disposed arm 4 is pushed aside by snowplow or other impinging body.

Gate 34 is provided with one or more ports 46 having a spring loaded flapper valve 47 for each port, mounted on the trailing face 48 of gate 34 that is opened by hydraulic pressure as the gate approaches point E. After stopping and reversing toward normal position from the tensive energy of the spring 22, the flapper valve 47 is firmly closed by hydraulic pressure into its beveled slot or seat around port 46. As the gate end reaches point E on its return, fluid flow is restricted to the bleed-by allowed by the minimal clearance at the end and top and bottom of the gate. This will slow the reversing action, causing a delay in the return to normal of the horizontal arm 4 of the apparatus. This delay will allow the snowplow and its vehicle, or impinging body, to continue along its way without being raked by the arm during passage.

Full baffle wall 50 provides fluid containment on opposite sides of the gate 34 for needed hydraulic forces to operate. The slotted collaring 51 in the baffle wall around the shaft helps keep the shaft solidly placed to maintain proper clearance.

The same result in the case of rotation from opposite direction impingement on the apparatus arm can be achieved by providing a second or alternative canister, as for example in FIG. 8, penetrated by the same shaft but with the gate mounted on the opposite side and the truncation and baffling similarly reversed, as shown in FIG. 8, in which the same numerals as FIG. 7 are used. In the case of placing the delay point in a quadrant, as shown in FIG. 8, the process of providing delay for opposite direction impingement would involve intermediate gearing (not shown) in the second canister between the primary shaft and a second shaft carrying the gate control. The principle of the delay is not limited to the configurations shown, but could incorporate such features as nodes or thickened interior wall sections anywhere along the operative arc, to provide various points or sections of delay by restricted flow.

While a presently preferred embodiment of my invention is disclosed in this specification it is to be understood that the invention is not limited to the preferred embodiments disclosed but has the breadth of the appended claims.

What is claimed is:

1. A yieldable roadway marking and signing apparatus comprising a standard, an arm disposed in a first horizontal position and having a downward vertical extension, means for rotatably securing said arm to said standard, means for returning said arm to its first position after rotation, and means for delaying the return of said arm to its first position comprising a cylindrical sealed canister eccentrically disposed about a shaft operatively connected to said vertical extension of said arm, fluid in said canister, gate means attached to said shaft and pivotally responsive to the rotation of said vertical extension, a wall in said cylindrical canister sealing the space between the vertical extension of said arm and canister wall opposite said gate means, a restriction between said gate and the wall of said canister created by said eccentric positioning at some point in the arc of travel of said gate, whereby the gate may move in a first direction to the restriction and its return to its first position is delayed by the restriction.

2. The apparatus of claim 1 with the addition of check valve means disposed in said gate, whereby said gate may move more freely in said first direction.

3. The apparatus of claim 1 wherein said arm is provided with a depending signboard and hinge means at its connection with said arm.

4. The apparatus of claim 1 wherein said means for rotatably securing said arm to said standard and returning said arm to its first position after rotation comprises a vertical extension of said arm, and resilient restraint means associated with said extension whereby the arm is deflected to a second position by pressure and is urged to its first position upon release of pressure.

5. The apparatus of claim 4 wherein said resilient restraint means comprises a vertically disposed sleeve means attached to said standard and engaging said extension and resilient means attaching said sleeve means to said extension, whereby energy is stored in said resilient means when said arm is deflected and works to return said arm to its first position.

6. The apparatus of claim 4 with the addition of means for guiding said arm to accurate alignment in its first position.

7. The apparatus of claim 6 said means for guiding said arm to accurate alignment with its first position comprises a notch disposed in the upper end of said sleeve.

8. The apparatus of claim 7 with the addition of means for adjusting said notch.

9. The apparatus of claim 4 wherein said resilient restraint means is a torsion bar.

10. The apparatus of claim 1 wherein said arm has a bend intermediate its point of attachment to said standard and its other end.

11. The apparatus of claim 1 wherein said bend defines an angle of thirty degrees.

* * * * *